United States Patent [19]

Davis

[11] 4,103,592

[45] Aug. 1, 1978

[54] VALVE OPERATOR

[75] Inventor: Donald H. Davis, Scotia, N.Y.

[73] Assignee: General Electric Company, Schenectady, N.Y.

[21] Appl. No.: 754,055

[22] Filed: Dec. 23, 1976

Related U.S. Application Data

[63] Continuation of Ser. No. 642,396, Dec. 19, 1975, abandoned.

[51] Int. Cl.[2] ..... F15B 11/08; F15B 13/04

[52] U.S. Cl. ..... 91/448; 91/415; 91/451; 92/168

[58] Field of Search ..... 91/448, 451, 415, 417; 92/153, 168; 277/15; 251/31

[56] References Cited

U.S. PATENT DOCUMENTS

| | | | |
|---|---|---|---|
| 503,068 | 8/1893 | Austin | 91/417 R |
| 607,265 | 7/1898 | McLean | 251/31 |
| 970,435 | 9/1910 | Dourte | 92/153 X |
| 2,143,637 | 1/1939 | Vollmann | 277/15 X |
| 2,330,781 | 9/1943 | Langmyhr | 92/153 X |
| 2,826,216 | 3/1958 | Thomas | 91/417 R |
| 3,073,340 | 1/1963 | Hancock | 91/417 R |
| 3,226,078 | 12/1965 | Anderson | 251/31 X |
| 3,451,423 | 6/1969 | Priese | 251/31 X |
| 3,495,501 | 2/1970 | Kure-Jensen | 91/440 |
| 3,922,955 | 12/1975 | Kast | 137/625.62 X |

*Primary Examiner*—Irwin C. Cohen

*Attorney, Agent, or Firm*—James W. Mitchell; John F. Ahern

[57] ABSTRACT

A valve operator is disclosed for controlling an inlet valve to a large fluid-driven turbomachine such as a steam turbine. Such a valve is subject to a fast closing requirement under emergency trip conditions and at other times, the valve may be required to provide a precise steam flow regulating function. The present invention responds to these various requirements by providing a valve operator capable of fast closing by means of a disk-dump valve within the valve operator for rapid hydraulic fluid evacuation. In addition, the precise control of steam flow is accomplished by including a double-acting hydraulic cylinder within the valve operator.

3 Claims, 1 Drawing Figure

VALVE OPERATOR

This is a continuation of application Ser. No. 642,396, filed Dec. 19, 1975, and now abandoned.

BACKGROUND OF THE INVENTION

The present invention relates, in general, to valve operating mechanisms as applied to an inlet valve upstream from a large fluid-driven turbomachine; and, in particular, the present invention is directed to a valve operator which provides for fast closing and precise control of the inlet valve.

One requirement for operating a large steam turbine is that upstream from the steam turbine in the steam inlet line at least one control valve must be provided having a capability for almost instantaneous shutdown of the steam flow to the turbine under emergency trip conditions. Moreover, the valve must be capable of precise regulation of the steam flow especially under conditions approaching the rated speed of the turbine. It has been found that it may be advantageous to apply butterfly-type valves in a steam inlet line in place of certain prior art rod and plunger-type valves. The advantages of utilizing a butterfly-type valve as an inlet flow control valve have been pointed out in U.S. Patent Application Ser. No. 588,767 to Davis and Mossey filed June 20, 1975 now U.S. Pat. No. 4,020,869 and assigned to the assignee of the present invention. However, because the butterfly valve is disposed directly across the steam flow path certain unique operating characteristics must be considered in the design of a valve operator.

Under normal operating conditions, the steam inlet valve will be fully opened and the pressure drop across the valve will be relatively low. As the valve may be closed in order to throttle the inlet steam flow, the pressure drop across the valve becomes increasingly significant. One resultant condition which occurs as the pressure drop across the valve increases is an increase in bearing friction between the valve shaft and the valve casing.

Because of the foregoing conditions, it has been found that for controlling modern steam valves upstream from a turbine at relatively low rates of movement, it is necessary that a valve operator be capable of applying forces of greater magnitude during slow movement than those forces which are required for emergency tripping. It is undesirable to employ a more massive closing spring to achieve greater operating forces since this would require a larger piston and more heavy-duty hydraulics which might adversely affect the reliability of the system and increase the time required for valve closing. The present invention increases the operating forces necessary for the slow positioning of steam valves by providing an additional hydraulic force in the valve closing direction through the use of a double-acting hydraulic cylinder.

Hence, it is one object of the present invention to provide a valve operator capable of fast closing a steam inlet valve whereas the same valve operator is also capable of precise slow positioning of the steam inlet valve.

Another aspect of the present invention is the evacuation of hydraulic fluid during an emergency trip. A servo valve could be employed to provide for emergency fluid evacuation but because of the large flow necessary to reduce valve closing time, the servo valve would have to be very large. The present invention uses a disk-dump valve of the kind shown in U.S. Pat. No. 3,495,501 to Kure-Jensen issued Feb. 17, 1970. However, unlike the invention shown in U.S. Pat. No. 3,495,501, a separate drain tank must be provided for the hydraulic fluid in the present invention wherein a double-acting hydraulic cylinder is also provided for slow movement control.

It is also an object of the present invention to provide a valve operator having an improved hydraulic fluid evacuation system.

Another aspect of the present invention also concerns an emergency trip wherein it is possible to draw in air to the hydraulic cylinder above the piston during an emergency trip. In order to obviate this possibility an effective fluid seal is applied to the valve operator in combination with the drain tank.

It is a further object of the present invention to provide an effective fluid seal above the double-acting hydraulic cylinder to prevent the ingress of air into the volume above the piston during an emergency trip.

Other objects, advantages and features of the present invention will become apparent from the following description of a preferred embodiment thereof when taken in connection with the accompanying drawing.

SUMMARY OF THE INVENTION

The inlet conduit immediately upstream from a large steam turbine includes a steam control valve which is both finely positionable and fast closing by means of a remotely controlled valve operator. The valve operator includes a hydraulic manifold for delivering hydraulic fluid to either side of a double-acting hydraulic cylinder for fine positioning of the steam valve. The steam valve is connected to a valve actuating rod which is, in turn, positioned by a piston slidable within the hydraulic cylinder. The fast closing aspect of the present invention is accomplished by a disk-dump valve within the hydraulic manifold which is connected to an external drain tank. The drain tank itself is fluidly connected to the hydraulic cylinder for providing a fluid seal about the valve actuating rod to prevent air from entering the hydraulic cylinder during fast closing.

DETAILED DESCRIPTION OF THE INVENTION

Figure 1:
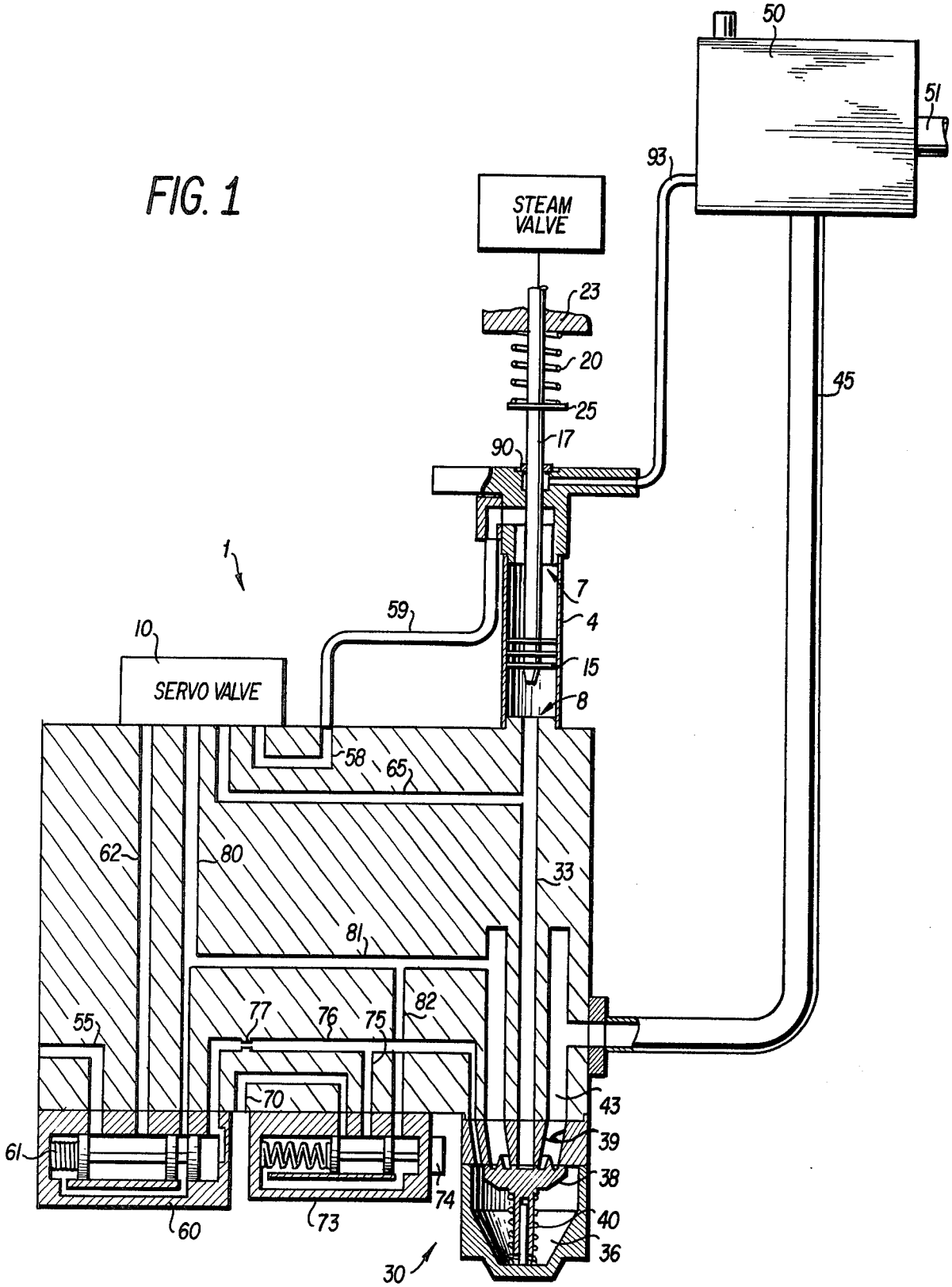
FIG. 1, is an elevation view in partial cross section of a valve operator according to the present invention.

A valve operator comprises a hydraulic manifold block 1 which supplies hydraulic fluid to a double-acting hydraulic cylinder 4 which has a first or upper end 7 and a second or lower end 8 for receiving hydraulic fluid in accordance with the position setting on servo valve 10. A valve actuating piston 15 is slidably mounted within the hydraulic cylinder 4 and includes, at one end thereof, a valve actuating rod 17 which mechanically links the hydraulic cylinder with the inlet steam valve. The control valve may be any type of suitable control valve including, for example, a butterfly-type control valve. Rod 17 is biased in the valve closed direction by means of a valve closing spring 20 having a fixed seat 23 at one end and engaging, at the other end, a spring retainer 25 fixed to the valve actuating rod. Spring 20 provides the necessary force for fast closing the steam valve when the valve operator is tripped in response to an emergency condition.

In order to open the steam valve, hydraulic fluid is applied to the lower end 8 of the hydraulic cylinder 4. In the event of an emergency trip, the fluid below the piston 15 must be rapidly dumped. In order to provide for a rapid evacuation of the hydraulic cylinder, a disk-dump valve 30 is in fluid communication with the lower end 8 of the hydraulic cylinder 4 through a drain line 33. The disk-dump valve 30 includes a pressure chamber 36 to which pilot pressure is applied in the valve reset mode. A valve disk 38 is pressed against a valve seat 39 by means of the pilot pressure. Spring 40 functions to reset the valve disk against the annular valve seat 39 prior to the application of pilot pressure. The disk-dump valve connects the hydraulic manifold to a drain tank 50 through annular pipe 43 and pipe 45. The drain tank 50 also further includes a drain 51 which may be connected to an oil reservoir (not shown); and, a vent is shown at the top of the tank 50.

Hydraulic fluid is supplied to the hydraulic manifold through a stop valve 60 and a trip valve 73. The trip valve sets the stop valve into an open position by supplying hydraulic fluid against the closing force of a spring 61. As is illustrated in the drawing, hydraulic fluid will enter the stop valve 60 through inlet 55 and is sent to the servo valve 10 through supply conduit 62. Should the hydraulic pressure to valve 60 from valve 73 be cut off, the valve 60 will close under the influence of spring 61 thereby interrupting the fluid supply to the servo valve and the hydraulic cylinder.

The trip valve 73 is controlled by a trip actuator 74 which positions the valve spool. In the position shown, pilot fluid is input into valve 73 through an inlet 70 whereupon it exits the valve through supply conduit 75. The flow output of conduit 75 is input into pressure chamber 36 to pressurize the dump valve disk 38 and also to pressurize the supply valve 60. Metering orifice 77 in conduit 76 ensures that the dump valve disk is pressurized before the supply of hydraulic fluid to the servo valve is resumed. Servo valve 10 supplies hydraulic fluid to the upper end of the hydraulic cylinder through manifold line 58 and conduit 59 in order to move the steam valve slowly and precisely toward a valve close position. Servo valve 10 supplies hydraulic fluid to the lower end of the hydraulic cylinder through manifold line 65 in order to move the steam valve slowly and precisely to a valve open position.

Lines 80, 81 and 82 are all drain lines which communicate with annular pipe 43 and eventually the drain tank 50 if a trip situation occurs.

A fluid seal 90 is provided around the surface of rod 17 in order to prevent the leakage of air into double-acting cylinder 4 when piston 15 moves rapidly downward during a trip condition. Fluid seal 90 provides a positive hydraulic fluid pressure at the surface of rod 17 and is supplied with fluid from drain tank 50 through a fluid seal supply conduit 93. The location of the drain 51 ensures that the level of hydraulic fluid in drain tank 50 will be maintained above the level of the conduit 93. Moreover, drain tank 50 is located above seal 90 to provide a gravity feed of hydraulic fluid to the seal.

OPERATION

Under normal operating conditions, a steam valve will be in a fully open position as set by the valve operator which raises piston 15 against the force of closing spring 20 by applying hydraulic fluid through conduit 65 to the lower end 8 of the hydraulic cylinder and as determined by the positioning of the servo valve 10. Dump valve disk 38 is seated by pilot pressure applied in chamber 36 and stop valve 60 is held open against the closing force of spring 61.

If a trip condition occurs, the trip actuator 74 causes the trip valve spool to move right thereby shutting off the inflow of pilot pressure through conduit 70. Moreover, pilot fluid contained in stop valve 60 and pressure chamber 36 is dumped through conduit 76 and drain 82 into drains 81 and 43. The loss of pilot pressure under the dump valve disk 38 causes the valve disk to unseat and thereby rapidly evacuate all drains and the lower end of cylinder 4 causing the immediate closing of the inlet steam valve. The evacuated fluid goes to the drain tank 50 through line 45 where it may further be drained to a reservoir. Meanwhile, fluid seal 90 prevents air from being ingested into the upper end of the double-acting cylinder.

If slow control of the steam valve is required, hydraulic fluid is input into the upper end 7 of the double-acting hydraulic cylinder in order to slowly close the steam valve against hydraulic fluid which is input into the lower end 8 of the double-acting hydraulic cylinder in order to hold the valve open against the force of valve closing spring 20. In this mode of operation, the additional closing force for precise valve positioning is provided by the addition of hydraulic fluid to the upper end of the hydraulic cylinder. The control of hydraulic fluid to either end of the hydraulic cylinder is provided by the servo valve 10.

While there has been shown what is considered to be the preferred embodiment of the present invention, other modifications may occur to those skilled in the art; and, it is intended to cover in the appended claims all such modifications as fall within the true spirit and scope of the invention.

What is claimed is:

1. A valve operator for providing remote control of a controlled valve which is both fast closing and slowly positionable; said valve operator comprising:

a double-acting hydraulic cylinder having first and second opposite, open ends with a valve actuating piston slidable therebetween, said valve actuating piston biased by a spring in the valve close direction and including a rod connectable to a controlled valve;

a hydraulic manifold including a servo valve in fluid communication with each opposite end of said hydraulic cylinder whereby an input of hydraulic fluid to the first end of said hydraulic cylinder moves the controlled valve toward a closed position and the input of hydraulic fluid to the second end of said hydraulic cylinder moves the controlled valve toward a valve open position;

a disk-dump valve in fluid communication with the second end of said hydraulic cylinder;

a drain tank in fluid communication with the second end of said hydraulic cylinder through said disk-dump valve;

sealing means in fluid communication with the first end of said hydraulic cylinder, said sealing means circumferentially positioned about the valve actuating piston rod; and, a fluid supply conduit interconnecting the drain tank and sealing means, the fluid level in said drain tank being maintained at a level sufficient to apply fluid pressure to said seal means, whereby fluid from the second end of said hydraulic cylinder may be dumped to said drain tank through said disk-dump valve whereupon it pressurizes said sealing means through said fluid supply conduit.

2. The valve operator recited in claim 1 further comprising:

a stop valve for controlling the inflow of hydraulic fluid to said servo valve; and, a trip valve selectively positioning said stop valve and said disk-dump valve in a tripped and reset position.

3. The valve operator recited in claim 1 wherein the drain tank is located above the sealing means to provide a gravity feed of pressurized fluid to said sealing means.

* * * * *